US009528315B2

(12) United States Patent
Kim

(10) Patent No.: US 9,528,315 B2
(45) Date of Patent: Dec. 27, 2016

(54) PREFABRICATED STRUCTURE OF COMPOSITE WINDOW/DOOR APPARATUS USING DIFFERENT FRAME MATERIALS

(71) Applicants: IDA CO., LTD., Jori-eup Paju-si, Gyeonggi-do (KR); Soon Seok Kim, Jori-eup Paju-si, Gyeonggi-do (KR)

(72) Inventor: Soon Seok Kim, Jori-eup Paju-si (KR)

(73) Assignee: IDA CO., LTD., Seoul (KR)

( * ) Notice: Subject to any disclaimer, the term of this patent is extended or adjusted under 35 U.S.C. 154(b) by 124 days.

(21) Appl. No.: 14/532,026

(22) Filed: Nov. 4, 2014

(65) Prior Publication Data

US 2015/0121788 A1 May 7, 2015

(30) Foreign Application Priority Data

Nov. 5, 2013 (KR) ..... 10-2013-0133725

(51) Int. Cl.
*E06B 3/96* (2006.01)
*E06B 3/968* (2006.01)
(Continued)

(52) U.S. Cl.
CPC ..... *E06B 3/16* (2013.01); *E06B 3/163* (2013.01); *E06B 3/20* (2013.01); *E06B 3/22* (2013.01); *E06B 3/222* (2013.01); *E06B 3/26341* (2013.01); *E06B 3/9765* (2013.01); *E06B 3/12* (2013.01); *E06B 3/26347* (2013.01); *E06B 3/4609* (2013.01); *E06B 3/9682* (2013.01)

(58) Field of Classification Search
CPC ..... E06B 3/96; E06B 3/964; E06B 3/968; E06B 3/9681; E06B 3/9688; E06B 3/9636; E06B 3/9687; E06B 3/16; E06B 3/22;E06B 3/222; E06B 3/5892; E06B 3/5454; E06B 1/28; E06B 1/52; E06B 1/02; E06B 1/36; E06B 1/62; E06B 1/32
USPC ..... 52/201.1, 204.5, 204.55, 204.57, 204.58,52/204.62, 204.68, 210, 213–217, 204.7,52/204.6; 49/504
See application file for complete search history.

(56) References Cited

U.S. PATENT DOCUMENTS 2,701,040 A * 2/1955 Wick, Sr. ..... 403/295
2,703,159 A * 3/1955 Van Fleet ..... 52/656.5
(Continued)

FOREIGN PATENT DOCUMENTS

JP 2003301670 10/2003
JP 2008215036 9/2008
(Continued)

*Primary Examiner* — Joshua J Michener
*Assistant Examiner* — Kyle Walraed-Sullivan
(74) *Attorney, Agent, or Firm* — Mark M. Friedman

(57) ABSTRACT

A prefabricated structure for a composite window apparatus using different frame materials.
The sides of the corners of adjacent first window frames and adjacent first sash frame which made of synthetic resin are punched, the punched parts of the first window frames, the punched parts of the first sash frames and the parts of the angle pieces are bent inwardly. When the punched parts of the angle piece are bent into the corner piece, the window frame compression flanges of the first window frames are pressurized by the angle piece and the corner piece, and the sash frame compression flanges of the first sash frames are pressurized by the angle piece and the corner piece, so that the corners of the first window frames and the corners the first sash frames are connected to respective angle pieces and corner pieces.

4 Claims, 9 Drawing Sheets

(51) Int. Cl.

| | |
|---|---|
| ***E06B 1/04*** | (2006.01) |
| ***E06B 3/16*** | (2006.01) |
| ***E06B 3/22*** | (2006.01) |
| ***E06B 3/263*** | (2006.01) |
| ***E06B 3/976*** | (2006.01) |
| ***E06B 3/20*** | (2006.01) |
| *E06B 3/12* | (2006.01) |
| *E06B 3/46* | (2006.01) |

(56) References Cited

U.S. PATENT DOCUMENTS

| | | | | |
|---|---|---|---|---|
| 3,081,849 | A * | 3/1963 | Hubbard | 52/464 |
| 3,434,749 | A * | 3/1969 | Meyer | 403/13 |
| 3,479,770 | A * | 11/1969 | Mock | 49/501 |
| 3,698,114 | A * | 10/1972 | Hirsch et al. | 40/782 |
| 3,782,054 | A * | 1/1974 | Goss, Jr. | 403/295 |
| 3,812,621 | A * | 5/1974 | Ragland | 49/505 |
| 3,866,380 | A * | 2/1975 | Benson | 52/656.6 |
| 3,899,258 | A * | 8/1975 | Matthews | 403/292 |
| 3,949,526 | A * | 4/1976 | Sherlock et al. | 49/501 |
| 3,990,196 | A * | 11/1976 | Eddins | 52/106 |
| 4,023,293 | A * | 5/1977 | Murray | 40/782 |
| 4,222,209 | A * | 9/1980 | Peterson | 52/172 |
| 4,524,112 | A * | 6/1985 | Willert | 428/595 |
| 4,555,869 | A * | 12/1985 | Kenkel | 49/449 |
| 4,640,048 | A * | 2/1987 | Winner et al. | 49/181 |
| 4,640,054 | A * | 2/1987 | Breimeier et al. | 49/504 |
| 4,831,804 | A * | 5/1989 | Sayer | 52/475.1 |
| 5,046,791 | A * | 9/1991 | Kooiman | 312/265.1 |
| 5,431,211 | A * | 7/1995 | Guillemet | 160/381 |
| 5,494,369 | A * | 2/1996 | Stock | 403/295 |
| 6,216,401 | B1 * | 4/2001 | Emek | 52/204.5 |
| 6,530,183 | B1 * | 3/2003 | Kuei-Yung | 52/204.1 |
| 8,028,489 | B1 * | 10/2011 | Lawrence | 52/656.7 |
| 8,245,462 | B2 * | 8/2012 | Miethe et al. | 52/204.7 |
| 8,448,394 | B2 * | 5/2013 | Miethe et al. | 52/204.7 |
| 8,511,011 | B2 * | 8/2013 | Emanuel | 52/204.1 |
| 2002/0083649 | A1 * | 7/2002 | Hollman | 49/504 |
| 2003/0208970 | A1 * | 11/2003 | Saelzer | 52/167.1 |
| 2007/0053766 | A1 * | 3/2007 | Lin | 411/389 |
| 2009/0000224 | A1 * | 1/2009 | Kerscher | 52/204.1 |
| 2009/0277108 | A1 * | 11/2009 | Hay et al. | 52/204.62 |
| 2009/0293387 | A1 * | 12/2009 | Miethe et al. | 52/204.62 |
| 2010/0175339 | A1 * | 7/2010 | Moriya et al. | 52/204.5 |
| 2010/0192508 | A1 * | 8/2010 | Subra | 52/656.9 |
| 2010/0293881 | A1 * | 11/2010 | Betz et al. | 52/656.2 |
| 2011/0194886 | A1 * | 8/2011 | Wu et al. | 403/23 |
| 2012/0279166 | A1 * | 11/2012 | Valler et al. | 52/656.2 |
| 2013/0064600 | A1 * | 3/2013 | Tseng et al. | 403/205 |
| 2013/0283723 | A1 * | 10/2013 | Engstrom | 52/656.9 |
| 2014/0318049 | A1 * | 10/2014 | Paquet et al. | 52/204.593 |

FOREIGN PATENT DOCUMENTS

| | | |
|---|---|---|
| KR | 200162141 | 1/1999 |
| KR | 100324496 | 2/2002 |
| KR | 101302093 | 8/2013 |

* cited by examiner

PREFABRICATED STRUCTURE OF COMPOSITE WINDOW/DOOR APPARATUS USING DIFFERENT FRAME MATERIALS

TECHNICAL FIELD

The present invention relates to a prefabricated structure for a composite window/door apparatus using different frame materials, and more particularly, to a prefabricated structure for a composite window/door apparatus using different frame materials, which enables a fabricator to simply and firmly connect adjacent first window frames made of synthetic resin together and adjacent first sash frame made of synthetic resin together just by punching, to secure window frame compression flanges of the first window frame between an angle piece and a corner piece and to secure sash compression flanges of the first sash frame between another angle piece and another corner piece, and to easily and securely connect the first window frame made of synthetic resin and the second window frame made of metal together and the first sash frame made of synthetic resin with the second sash frame made of metal together.

BACKGROUND ART

Luxurious and functional windows/doors of buildings have been developed in various forms for use. These include lift-sliding type system windows/doors which have been widely applied to relatively large windows/doors of living rooms or balconies, and security windows/doors having security functions.

Windows/doors used in many different buildings essentially include window/door frames to be connected with windows/doors to be opened/closed by a sliding motion. These windows/doors need to be weatherproof having high resistance to the outside air, durability and high mechanical properties to bear the load of glass.

In the conventional window/door system, a window/door frame includes a rail groove to be connected with a window/door to be opened/closed by a sliding motion. However, when people walk passing the rail groove, the rail grove causes a feeling of irritation to the feet or acts as a dangerous obstruction causing them to stumble. Further, in the window/door frame used in verandas, foreign substances including dust easily collect in the rail groove and it is difficult to clean and remove the foreign substances from the rail groove. Specifically, since a draft or rainwater easily comes into through the window/door frame used in the verandas and the rail groove thereof, air tightness and drainage are greatly reduced.

To solve the above-indicated drawbacks, a window/door having a hidden rail structure that does not expose the rail groove and improves air tightness and drainage has been launched. However, since a structure combining a window/door with a rail groove of a window/door frame is complicated, it is very difficult to separate the window/door from the rail groove. In addition, since no structure to drain rainwater is separately provided, drainage is not good. Moreover, since the structure to block a draft is simple, it fails to thoroughly block the draft from passing through.

Furthermore, in the conventional window/door having a hidden rail structure like a general window/door, heat or cold air from the outside is transmitted to the inside by the metal frame. Accordingly, a thermal loss by the heat conduction still occurs.

To solve the problems of the conventional art, the applicant of the present invention filed a patent application for a composite window/door apparatus using different frame materials and registered it as a patent (Korean Patent Registration No. 10-1302093).

The conventional composite window/door apparatus comprises a window frame using different materials and a sash frame using different materials.

The window frame using different materials comprises a first window frame made of synthetic resin and a second window frame made of metal. The first window frame forms a part of the window frame and it is to be positioned in an inside window frame installation space of a window frame installation space. The second window frame forms the rest window frame and it is to be positioned in an outside window frame installation space of the window frame installation space.

The sash frame using different materials comprises a first sash frame made of synthetic resin and a second sash frame made of metal, which form a sash frame of interior and exterior window glass. The first sash frame forms a part of an inside sash frame and is positioned inside. The second sash frame forms the rest of the sash frame and it is positioned outside to be connected with the first sash frame.

That is, the parts of the window frame and the sash frame to be positioned outside include the second window frame and second sash frame made of metal. The rest of the window frame and sash frame to be positioned inside include the first window frame and first sash frame made of synthetic resin to block heat conduction between the second window frame and second sash frame made of metal and inside.

However, the conventional composite window/door apparatus has a drawback: It is troublesome to connect the first window frame made of synthetic resin with the second window frame made of metal and to connect the first sash frame made of synthetic resin with the second sash frame made of metal. That is, after the first window frame and second window frame made of different materials are fit into each other and the first sash frame and second sash frame made of different materials are fit into each other, since an adhesive agent is applied or locking bolts are used to connect those frames together, assembling work is troublesome. Moreover, a sense of beauty on the frames using different materials lowers by the area where the adhesive agent is applied or the locking bolts are tightened.

The conventional composite window/door apparatus has another drawback in connecting the frames made of synthetic resin.

In the conventional composite window/door apparatus, the first window frames made of synthetic resin are connected together and the first sash frame made of synthetic resin are connected together by a heat-sealing method or an attaching method using an adhesive agent.

The heat-sealing method of the synthetic resin frames in the conventional composite window/door apparatus is as follows: The first window frame and first sash frame made of synthetic resin are cut, at an angle of 45 degrees, in their respective ends. To connect ends of the first window frames together and to connect ends of the first sash frame, the corresponding ends thereof are heated to be bonded together. Then, a bonded area which protrudes is cut to be flat by heating and pressurizing.

Additionally, the connecting method using an adhesive agent in the conventional composite window/door apparatus is as follows: To connect the ends of the first window frames made of synthetic resin together and to connect the ends of the first sash frames made of synthetic resin, these ends being cut at an angle of 45 degrees, an adhesive agent is applied to the corresponding ends of the frames to be connected together. After gluing the two ends where the adhesive agent is applied, it needs time to wait until the ends are completely glued together. Then, the adhesive agent outwardly protruding from the glued area is cut to make the outer surface of the connected area smooth.

However, the aforementioned heat-sealing method or attaching method using an adhesive agent to connect the synthetic resin frames has the problems in that: since the work process is troublesome, working time is delayed and labor cost is increased; since the glued area is not neat, the appearance beauty of the composite window/door apparatus is damaged; and the glued area easily loosens or deteriorates.

PRIOR ART LITERATURE

Patent Documents (Patent Document 1) Korean Patent Registration No. 10-0324496

(Patent Document 1) Korean Patent Registration No. 10-1302093

DISCLOSURE

Technical Problem

Therefore, it is an object of the present invention to solve the above problems and to provide a prefabricated structure for a composite window/door apparatus using different frame materials, which enables for a fabricator to easily and firmly connect adjacent first window frames made of synthetic resin together and adjacent first sash frames made of synthetic resin together by punching only, without using any heat-sealing method or adhesive agent.

It is another object of the present invention to provide a prefabricated structure for a composite window/door apparatus using different frame materials, which enables for a fabricator to securely connect window frame compression flanges of the first window frame between an angle piece and a corner piece and to securely connect sash compression flanges of the first sash frame between another angle piece and another corner piece since punched parts of each angle piece are deformed/cut and bent into receiving grooves of each corner piece upon punching, so that the angle pieces and the corner pieces are secured.

It is another object of the present invention to provide a prefabricated structure for a composite window/door apparatus using different frame materials, which enables for a fabricator to complete assembling by relatively easy work of pressurizing the top and bottom of a joined area of the first window frame made of synthetic resin and the second window frame made of metal and pressurizing the top and bottom of a joined area of the first sash frame made of synthetic resin and the second sash frame made of metal after connecting the first window frame with the second window frame by a sliding motion and connecting the first sash frame with the second sash frame by a sliding motion.

Technical Solutions

In accordance with an embodiment of the present invention, there is provided a prefabricated structure for a composite window/door apparatus using different frame materials which includes: a window frame using different materials including: a first window frame made of synthetic resin, which forms a part of a window frame and which is positioned in an inside window frame installation space of a window frame installation space, and a second window frame made of metal, which forms the rest of the window frame and which is positioned in an outside window frame installation space of the window frame installation space to be connected with the first window frame; and a sash frame using different materials including: a first sash frame made of synthetic resin, which forms a part of a sash frame having an exterior window/door and an interior window/door and which is positioned inside, and a second sash frame made of metal, which forms the rest of the sash frame and which is positioned outside to be connected with the first sash frame, the prefabricated structure characterized in that: each of the first window frame made of synthetic resin and the first sash frame made of synthetic resin includes its both ends which are cut at an angle of 45 degrees, the first window frame includes a corner piece path and an angle piece path which are lengthwise formed inside, and the first sash frame includes a corner piece path and an angle piece path which are lengthwise formed inside; the corner piece path of each of the first window frame and the first sash frame receives a corner piece made of metal, to connect corners of the adjacent first window frames together and corners of the adjacent first sash frames together; the angle piece path of each of the first window frame and the first sash frame receives an angle piece made of metal, to reinforce the connection of the corners of the first window frames and the connection of the corners of the first sash frames; and the first window frame includes window frame compression flanges between the corner piece path and the angle piece path, and the first sash frame includes sash frame compression flanges between the corner piece path and the angle piece path, and when the angle pieces are punched and punched parts of the angle pieces are bent towards the corner pieces, the window frame compression flanges and the sash frame compression flanges are pressurized by the angle pieces and the corner pieces and therefore the corners of the first window frames and the corners of the first sash frames are secured with the angle pieces and the corner pieces.

The corner piece includes receiving grooves formed at its outer surface and the angle piece includes punched and deformed/cut parts to enter into the receiving grooves of the corner piece upon punching.

The first window frame made of synthetic resin includes window frame joint grooves which are formed lengthwise, and the first sash frame made of synthetic resin includes sash frame joint grooves which are formed lengthwise; the second window frame made of metal includes window frame joint tongues which are formed lengthwise to be slidably connected with the window frame joint grooves, and the second sash frame made of metal includes sash frame joint tongues which are formed lengthwise to be slidably connected with the sash frame joint grooves; after the window frame joint grooves of the first window frame are slidably connected with the window frame joint tongues of the second window frame and the sash frame joint grooves of the first sash frame are slidably connected with the sash frame joint tongues of the second sash frame, the top and bottom of a joined part thereof are pressurized by a roller so that the window frame joint tongues are pressurized towards the window frame joint grooves to be connected with each other and the sash frame joint tongues are pressurized towards the sash frame joint grooves to be connected with each other.

Advantageous Effects

In the present invention, one of the corner pieces is inserted into the corner piece paths of the adjacent first window frames, to connect the corners of the first window frames together. Another corner piece is inserted into the corner piece paths of the adjacent first sash frames, to connect the corners of the first sash frames together. One of the angle pieces is inserted into the angle piece paths of the adjacent first window frames, to reinforce the connection of the corners of the first window frames. Another angle piece is inserted into the angle piece paths of the adjacent first sash frame, to reinforce the connection of the corners of the first sash frames. The window frame compression flanges protrude between the corner piece path and the angle piece path of the first window frame, and the sash compression flanges protrude between the corner piece path and the angle piece path of the first sash frame.

Accordingly, when the sides of the corners of the adjacent first window frames made of synthetic resin and the sides of the corners of the adjacent first sash frame made of synthetic resin are punched, the punched parts of the first window frames, the punched parts of the first sash frames made of synthetic resin and the parts of the angle pieces are deformed/cut and bent inwardly. When the punched parts of the angle piece are bent into the corner piece so as to be engaged together, the window frame compression flanges of the first window frames are pressurized by the angle piece and the corner piece, and the sash frame compression flanges of the first sash frames are pressurized by the angle piece and the corner piece, so that the corners of the first window frames are connected to the angle piece and the corner piece and the corners the first sash frames are connected to the angle piece and the corner piece. Therefore, the adjacent first window frames made of synthetic resin are simply and firmly connected with each other only by a punching step, without using any heat-sealing method or adhesive agent application. The adjacent first sash frame made of synthetic resin are connected with each other in the same manner. As a result, the end product assembly is highly improved and the appearance beauty of the window frame using different materials and the sash frame using different materials does not deteriorate.

In the present invention, the receiving grooves are formed on the outer surface of the corner piece of the present invention, and the punched and deformed/cut parts to enter into the receiving grooves of the corner piece are formed in the angle piece. Accordingly, when the sides of the connected area of the first window frames and the sides of the connected area of the first sash frames are punched, the punched parts of the first window frames made of synthetic resin, the punched parts of the first sash frames made of synthetic resin and the punched parts of the angle pieces made of metal are deformed/cut, so that the punched and deformed/cut parts of each angle piece are bent into the receiving grooves of each corner piece and therefor the angle piece and the corner piece are securely joined together. Since the angle piece and the corner piece are securely fixed to each other as the punched and deformed/cut parts of the angle piece are bent into the receiving grooves of the corner piece upon punching, the window frame compression flanges of the first window frames positioned therebetween and the sash frame compression flanges of the first sash frames positioned therebetween are securely connected between the angle piece and the corner piece. Therefore, the connected area of the first window frames made of synthetic resin and the connected area of the first sash frames made of synthetic resin are prevented from loosening or deteriorating.

In the present invention, the window frame joint grooves are lengthwise formed in the first window frame made of synthetic resin and the sash frame joint grooves are lengthwise formed in the first sash frame made of synthetic resin. The window frame joint tongues are lengthwise formed in the second window frame made of metal and the sash frame joint tongues are lengthwise formed in the second sash frame, so that the window frame joint tongues are connected with the window frame joint grooves by a sliding motion and the sash frame joint tongues are connected with the sash frame joint grooves by a sliding motion. Accordingly, after the window frame joint grooves of the first window frame are slidably connected with the window frame joint tongues of the second window frame and the sash frame joint grooves of the first sash frame are slidably connected with the sash frame joint tongues of the second sash frame, the top and bottom of the joined area thereof are pressurized by using the roller so that the window frame joint tongues are pressurized to be connected with the window frame joint grooves and the sash frame joint tongues are pressurized to be connected with the sash frame joint grooves. The assembly is completed by relatively simple work of pressing the top and bottom of the component made of metal after connecting two components made of different materials by a sliding motion. Since the window frame using different materials and the sash frame using different materials in the unique structure are very simply assembled, the end product assembly is improved.

DESCRIPTION OF DRAWINGS

These and other aspects and advantages of the present invention will become apparent and more readily appreciated from the following description of the embodiment(s), taken in conjunction with the accompanying drawings, in which.

BEST MODE

The technical characteristics of the present invention will be specifically described with reference to the accompanying drawings.

The phrase, 'different materials', means two different frame materials are used, one is synthetic resin and the other is metal.

Figure 1:
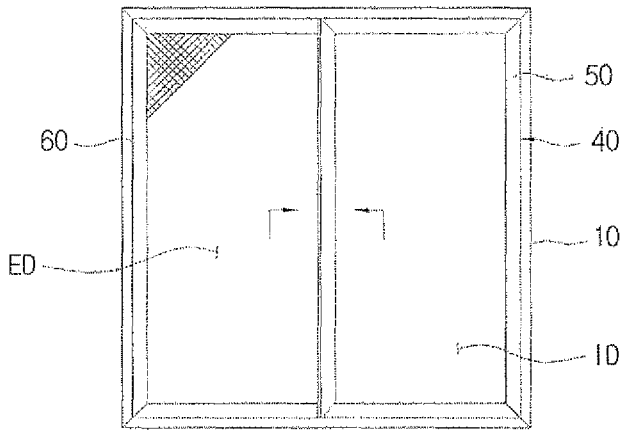
FIG. 1 is a front view of a prefabricated structure for a composite window/door apparatus using different frame materials according to an embodiment of the present invention.
Figure 2:
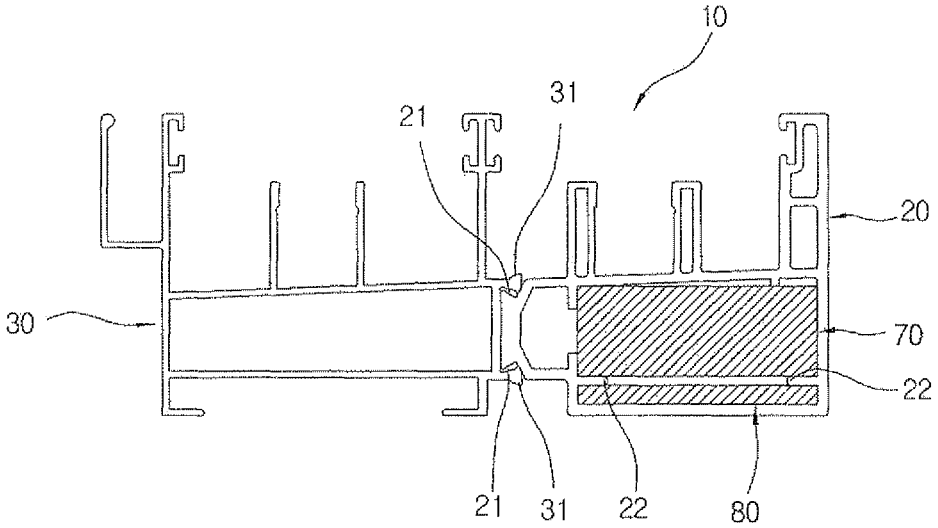
FIG. 2 is a schematic sectional view of the frame using different materials.
Figure 3:
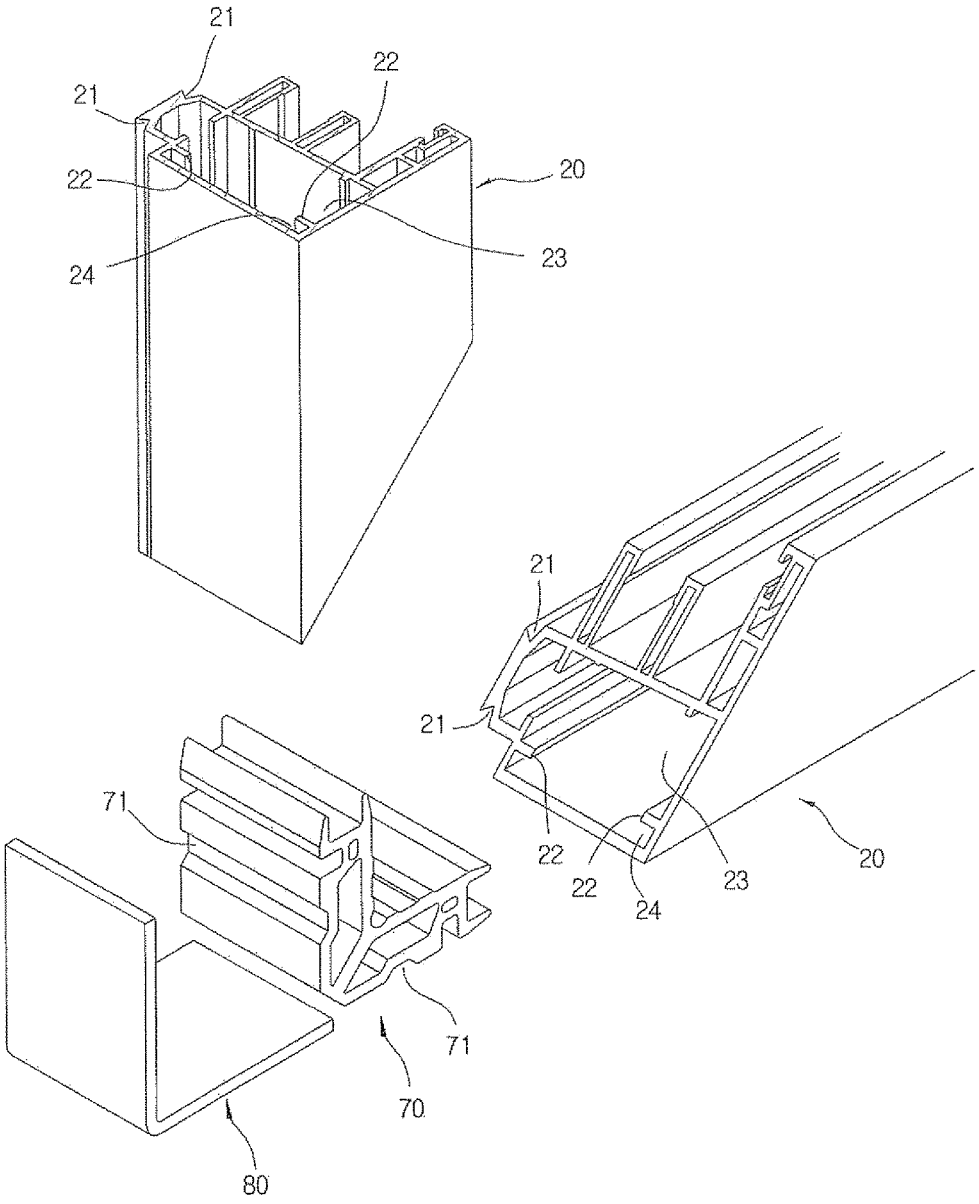
FIGS. 3 and 4 are partially exploded and connected schematic perspective views of a prefabricated structure of a first window frame made of synthetic resin.
Figure 4:
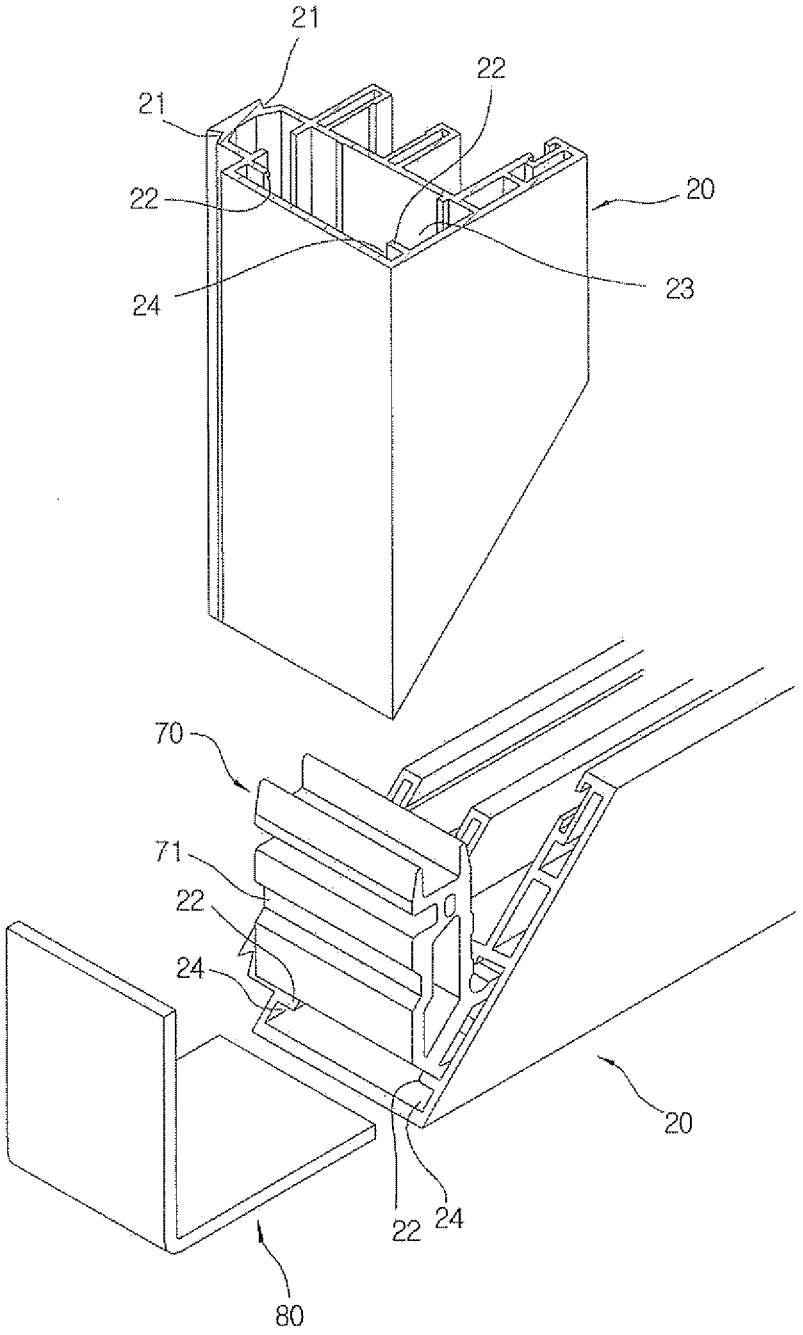
Figure 5:
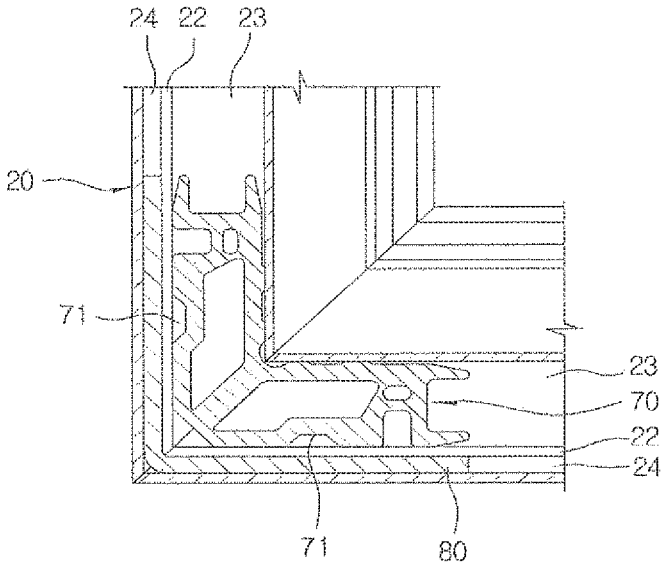
FIG. 5 is a partially sectional view showing the state that a corner piece and an angle piece are connected with the first window frame.
Figure 6:
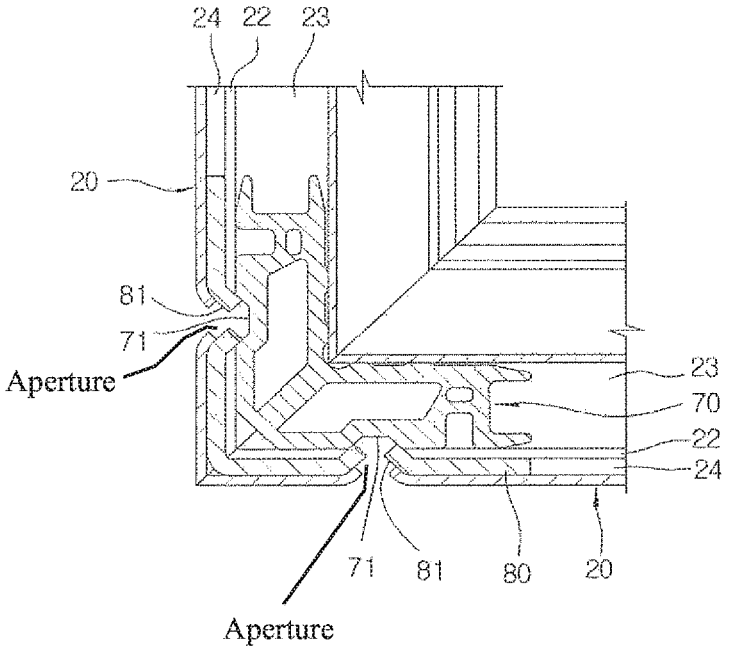
FIG. 6 is a connected sectional view showing the state that parts of the angle piece are punched and the punched deformed/cut parts are engaged in receiving grooves of the corner piece.
Figure 7:
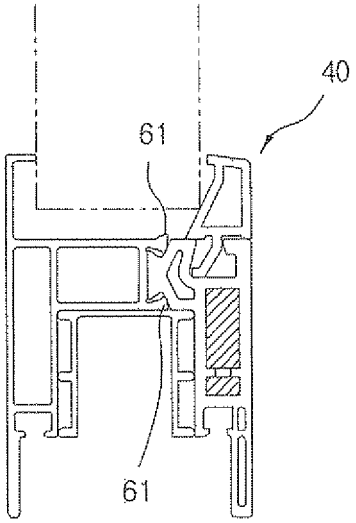
FIG. 7 is a partially sectional view showing the state that the corner piece and the angle piece are connected with a first sash frame.
Figure 8:
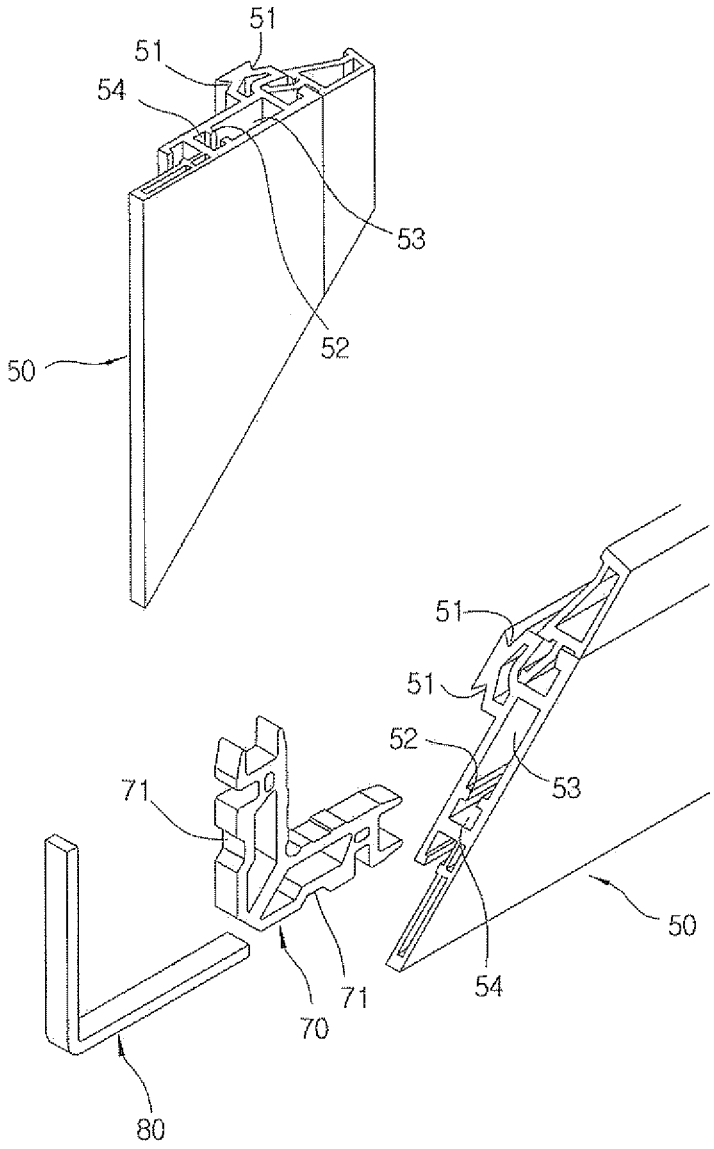
FIGS. 8 and 9 are partially exploded and connected schematic perspective views of a prefabricated structure of the first sash frame made of synthetic resin.
Figure 9:
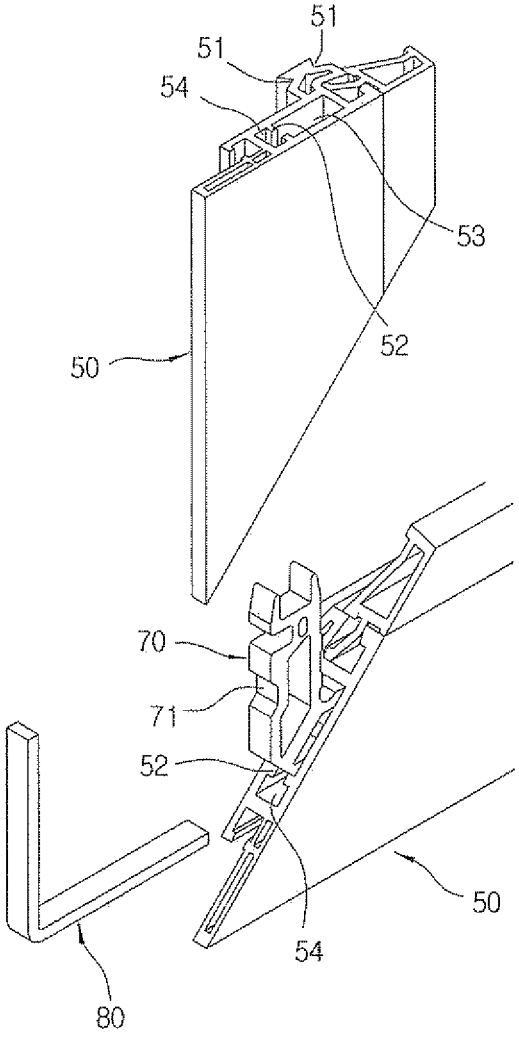
Figure 10:
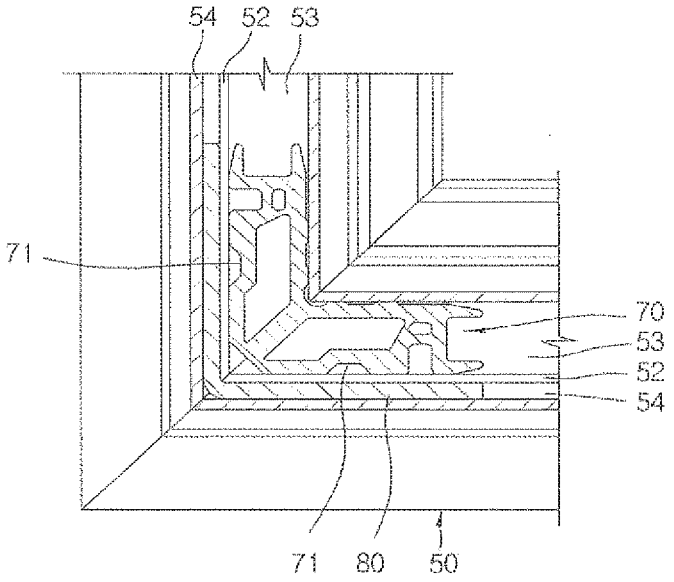
FIG. 10 is a partially sectional view showing the state that the corner piece and the angle piece are connected with the first sash frame.
Figure 11:
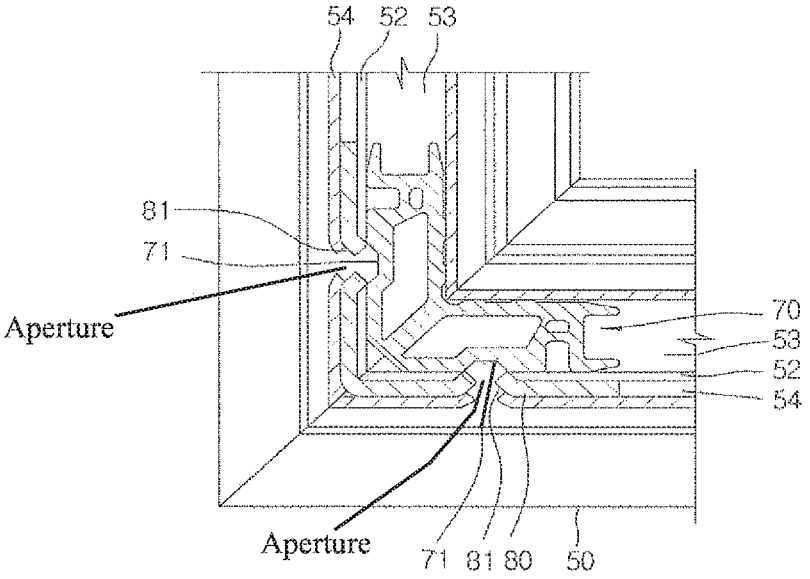
FIG. 11 is a connected sectional view showing the state that parts of the angle piece is punched and the punched and deformed/cut parts are engaged in the receiving grooves of the corner piece.

FIG. 1 is a front view of a prefabricated structure for a composite window/door apparatus using different frame materials according to an embodiment of the present invention, FIG. 2 is a schematic sectional view of the frame using different materials, FIGS. 3 and 4 are partially exploded and connected schematic perspective views of a prefabricated structure of a first window frame made of synthetic resin, FIG. 5 is a partially sectional view showing the state that a corner piece and an angle piece are connected with the first window frame, FIG. 6 is a connected sectional view showing the state that parts of the angle piece are punched and the punched deformed/cut parts are engaged in receiving grooves of the corner piece, FIG. 7 is a partially sectional view showing the state that the corner piece and the angle piece are connected with a first sash frame, FIGS. 8 and 9 are partially exploded and connected schematic perspective views of a prefabricated structure of the first sash frame made of synthetic resin, FIG. 10 is a partially sectional view showing the state that the corner piece and the angle piece are connected with the first sash frame, and FIG. 11 is a connected sectional view showing the state that parts of the angle piece is punched and the punched and deformed/cut parts are engaged in the receiving grooves of the corner piece.

A prefabricated structure for a composite window/door apparatus using different frame materials comprises a window frame 10 using different materials, a sash frame 40 using different materials, a corner piece 70 and an angle piece 80.

The window frame 10 using different materials comprises: a first window frame 20 made of synthetic resin and a second window frame 30 made of metal. The first window frame 20 forms a part of the window frame and it is positioned in an inside window frame installation space of a window frame installation space. The second window frame 30 forms the rest of the window frame and it is positioned in an outside window frame installation space of the window frame installation space.

The first window frame 20 made of synthetic resin includes window frame joint grooves 21 which are respectively formed at upper and lower positions of one side of the first window frame 20 lengthwise. The second window frame 30 made of metal includes window frame joint tongues 31. The window frame joint grooves 21 receive the window frame joint tongues 31 to be joined together by a sliding motion lengthwise.

Both ends of the first window frame 20 made of synthetic resin are cut at an angle of 45 degrees. Each end includes a corner piece path 23 and an angle piece path 24 which are lengthwise formed inside the first window frame 20.

The second window frame 30 made of metal includes the window frame joint tongues 31 which respectively protrude from upper and lower positions of one side of the second window frame 30 lengthwise. The window frame joint tongues 31 are slidably fit into the window frame joint grooves 21 of the first window frame 20 made of synthetic resin.

In the window frame 10 using different materials, after the window frame joint grooves 21 of the first window frame 20 are slidably joined with the window frame joint tongues 31 of the second window frame 30, the top and bottom of a joined area thereof are pressurized by a roller, so that the window frame joint tongues 31 are pressurized into the window frame joint grooves 21 to be connected together.

The sash frame 40 using different materials comprises a first sash frame 50 and a second sash frame 60. The first sash frame 50 forms a part of the sash frame comprising an exterior window/door (ED) and an interior window/door (ID). The first sash frame 50 is positioned inside and it is made of synthetic resin.

The second sash frame 60 forms the rest of the sash frame and it is positioned outside to be connected with the first sash frame 50. The second sash frame 60 is made of metal.

Both ends of the first sash frame 50 made of synthetic resin are cut at an angle of 45 degrees. A corner piece path 53 and an angle piece path 54 are formed inside the first sash frame 50 lengthwise.

One of the corner pieces 70 made of metal is inserted in the corner piece path 23 of the first window frame 20, to connect corners of the adjacent first window frames 20. Another corner piece 70 is inserted in the corner piece path 53 of the first sash frame 50, to connect corners of the adjacent first sash frames 50. Receiving grooves 71 are formed on an outer surface of the corner piece 70.

One of the angle pieces 80 made of metal is inserted in the angle piece path 24 of the first window frame 20, to reinforce the connection of the corners of the first window frames 20. Another angle piece 80 is inserted in the angle piece path 54 of the first sash frame 50, to reinforce the connection of the corners of the first sash frames 50. The angle piece 80 includes punched and deformed/cut parts 81 which are formed to be bent into the receiving grooves 71 of the corner piece 70.

Window frame compression flanges 22 protrude between the corner piece path 23 and the angle piece path 24 in the first window frame 20. Sash compression flanges 52 protrude between the corner piece path 53 and the angle piece path 54 in the first sash frame 50. Accordingly, when the angle piece 80 is punched and the punched parts of the angle piece 80 are bent towards the corner piece 70, the window frame compression flanges 22 and the sash compression flanges 52 are pressurized by the angle pieces 80 and the corner pieces 70, so that the corners of the first window frames 20 are connected with the angle piece 80 and corner piece 70 and the corners of the first sash frames 50 are connected with the angle piece 80 and corner piece 70.

The prefabricated structure for a composite window/door apparatus using different frame materials according to the present invention has the above-described constitution. A process of assembling the same is as follows:

To manufacture the window frame 10 using different materials and the sash frame 40 using different materials, the first window frame 20 and the first sash frame 50, which are respectively made of synthetic resin, are molded by extrusion, and the second window frame 30 and the second sash frame 60, which respectively made of metal, are formed by extrusion.

When the window frame 10 using different materials and the sash frame 40 using different materials are molded by extrusion, the first window frame 20 is connected with the second window frame 30 and the first sash frame 50 is connected with the second sash frame 60.

To connect the first window frame 20 with the second window frame 30, one end of the second window frame 30 is positioned at the end of the first window frame 20 to be joined together, and the window frame joint tongues 31 of the second window frame 30 are pushed to be fit into the window frame joint grooves 21 of the first window frame 20.

When the window frame joint grooves 21 of the first window frame 20 are slidably connected with the window frame joint tongues 31 of the second window frame 30, the top and bottom of a joined area thereof are pressurized by a roller (not shown), so that the window frame joint tongues 31 made of metal are completely pushed into the window frame joint grooves 21 so as to be tightly engaged with each other.

When the first window frame 20 is connected with the second window frame 30, the first sash frame 50 is connected with the second sash frame 60 by the aforementioned method. After one end of the second sash frame 60 is positioned to face the end of the first sash frame 50 to be joined together, the sash frame joint grooves 51 of the first sash frame 50 are pushed to be connected with the sash frame joint tongues 61 of the second sash frame 60, so that the first sash frame 50 and the second sash frame 60 are loosely connected with each other. The top and bottom of a joined area of the first sash frame 50 and the second sash frame 60 are pressurized by a roller (not shown), so that the sash frame joint tongues 61 made of metal are completely pushed into the sash frame joint grooves 51 so as to be engaged with each other.

When the window frame 10 using different materials and the sash frame 40 using different materials are respectively assembled in the above-described manner, the frames are cut to be suitable for the size of a window/door to be manufactured. Since both ends of the window frame 10 and both ends of the sash frame 40, which have been cut to size, are respectively cut at an angle of 45 degrees, a joint is to keep a diagonal line of 45 degrees when assembling each of the window frame 10 and the sash frame 40 into a square frame.

The ends of the window frame 10 and the ends of the sash frame 40 are cut to be suitable for the size of the window/door to be manufactured for assembly.

A process of assembling each of the window frame 10 and the sash frame 40, which have been cut, is as follows:

One end of the corner piece 70 is pushed to be fit into the corner piece path 23 of one of the adjacent first window frames 20 to be connected with each other and to be at a right angle and the other end of the corner piece 70 is pushed to be fit into the corner piece path 23 of the other first window frame 20. One end of the angle piece 80 is pushed to be fit into the angle piece path 24 of one of the first window frames 20 and the other end of the angle piece 80 is pushed to be fit into the angle piece path 24 of the other first window frame 20.

When the corner piece 70 and the angle piece 80 are connected with the corners of the first window frames 20 to be connected as shown in FIG. 5, parts of the connected area of the first window frames 20 corresponding to the receiving grooves 71 of the corner piece 70 are punched as shown in FIG. 6.

When the first window frames 20 made of synthetic resin are punched, the punched parts of the first window frames 20 made of synthetic resin and the punched parts of the angle piece 80 made of metal are deformed/cut, bent and forced into the receiving grooves 71 of the corner piece 70.

Here, even though the deformed/cut parts of the first window frames 20 are bent into the receiving grooves 71 of the corner piece 70, they do not greatly increase a binding force on the characteristics of synthetic resin.

However, the angle piece 80 made of metal is different. When the angle piece 80 made of metal is punched together with the first window frames 20 made of synthetic resin, the punched and deformed/cut parts 81 are formed. When the punched and deformed/cut parts 81 are engaged with the receiving grooves 71 of the corner piece 70, a strong connection force is generated between the angle piece 80 made of metal and the corner piece 70 made of metal.

Accordingly, the window frame joint protrusions 22 of the first window frames 20 positioned between the angle piece 80 and the corner piece 70 are securely engaged between the angle piece 80 and the corner piece 70 and, therefore, the connected area of the first window frames 20 is engaged with the angle piece 80 and the corner piece 70, to be joined together.

The corners of the adjacent first window frames 20 made of synthetic resin are connected by the aforementioned assembling method. However, to connect the corners of the adjacent second window frames 30 made of metal, which are to form one of the corners of the window frame 10 using different materials at a right angle, one end of the corner piece 70 is inserted into one end of one second window frame 30 and the other end of the corner piece 70 is inserted into the end of the other second window frame 30 to be joined together. In this state, the second window frames 30 to be connected together are punched and then parts of the second window frames 30 made of metal enter into the receiving grooves 71 of the corner piece 70 to be engaged and joined together.

The sash frame 40 using different materials having the first sash frame 50 and the second sash frame 60, each having both ends to be cut at an angle of 45 degrees, is assembled as follows:

One end of the corner piece 70 is pushed to be fit into the corner piece path 53 of one of the adjacent first sash frames 50 to be connected together and to be at a right angle and the other end of the corner piece 70 is pushed to be fit into the corner piece path 53 of the other first sash frame 50. One end of the angle piece 80 is pushed to be fit into the angle piece path 54 of the one first sash frame 50 and the other end of the angle piece 80 is pushed to be fit into the angle piece path 54 of the other first sash frame 50.

When the corner piece 70 and the angle piece 80 are connected with the corners of the first sash frames 50, parts of the connected area of the first sash frames 50 corresponding to the receiving grooves 71 of the corner piece 70 are punched.

When the first sash frames 50 made of synthetic resin are punched, punched parts of the first sash frames 50 made of synthetic resin and punched parts of the angle piece 80 made of metal are deformed/cut, bent and forced into the receiving grooves 71 of the corner piece 70.

Here, even though the punched and deformed/cut parts of the first sash frames 50 are bent into the receiving grooves 71 of the corner piece 70, they do not greatly increase the binding force on the characteristics of synthetic resin.

However, the angle piece 80 made of metal is different. When the parts of the angle piece 80 made of metal are punched together with the parts of the first sash frames 50 made of synthetic resin, the punched and deformed/cut parts 81 are formed. When the punched and deformed/cut parts 81 are engaged with the receiving grooves 71 of the corner piece 70, a strong connection force is generated between the angle piece 80 made of metal and the corner piece 70 made of metal.

Accordingly, the sash frame joint protrusions 52 of the first sash frames 50 respectively positioned between the angle piece 80 and the corner piece 70 are securely engaged between the angle piece 80 and the corner piece 70 and, therefore, the connected area of the first sash frames 50 is engaged with the angle piece 80 and the corner piece 70, to be joined together.

The corners of the first sash frames 50 made of synthetic resin are connected by the aforementioned assembling method. However, to connect the corners of the adjacent second sash frames 60 made of metal, which are to form one of the corners of the sash frame 40 using different materials at a right angle, one end of the corner piece 70 is inserted into one of the ends of the second sash frame 60 and the other end of the corner piece 70 is inserted into the end of the other second sash frame 60 to be connected together. In this state, the second sash frames 60 to be connected together are punched and then parts of the second sash frames 60 made of metal enter into the receiving grooves 71 of the corner piece 70 to be engaged and securely joined together.

The above-described present invention has the following advantages:

First, one of the corner pieces 70 is inserted into the corner piece paths 23 of the adjacent first window frames 20, to connect the corners of the first window frames 20 together. Another corner piece 70 is inserted into the corner piece paths 53 of the adjacent first sash frames 50, to connect the corners of the first sash frames 50 together. One of the angle pieces 80 is inserted into the angle piece paths 24 of the adjacent first window frames 20, to reinforce the connection of the corners of the first window frames 20. Another angle piece 80 is inserted into the angle piece paths 54 of the adjacent first sash frame 50, to reinforce the connection of the corners of the first sash frames 50. The window frame compression flanges 22 protrude between the corner piece path 23 and the angle piece path 24 of the first window frame 20, and the sash compression flanges 52 protrude between the corner piece path 53 and the angle piece path 54 of the first sash frame 50.

Accordingly, when the sides of the corners of the adjacent first window frames 20 made of synthetic resin and the sides of the corners of the adjacent first sash frame 50 made of synthetic resin are punched, the punched parts of the first window frames 20, the punched parts of the first sash frames 50 made of synthetic resin and the parts of the angle pieces 80 are deformed/cut and bent inwardly. When the punched parts of the angle piece 80 are bent into the corner piece 70 so as to be engaged together, the window frame compression flanges 22 of the first window frames 20 are pressurized by the angle piece 80 and the corner piece 70, and the sash frame compression flanges 52 of the first sash frames 50 are pressurized by the angle piece 80 and the corner piece 70, so that the corners of the first window frames 20 are connected to the angle piece 80 and the corner piece 70 and the corners the first sash frames 50 are connected to the angle piece 80 and the corner piece 70.

Therefore, the adjacent first window frames 20 made of synthetic resin are simply and firmly connected with each other only by a punching step, without using any heat-sealing method or adhesive agent application. The adjacent first sash frame 50 made of synthetic resin are connected with each other in the same manner. As a result, the end product assembly is highly improved and the appearance beauty of the window frame 10 using different materials and the sash frame 40 using different materials does not deteriorate.

Second, the receiving grooves 71 are formed on the outer surface of the corner piece 70 of the present invention, and the punched and deformed/cut parts 81 to enter into the receiving grooves 71 of the corner piece 70 are formed in the angle piece 80.

Accordingly, when the sides of the connected area of the first window frames 20 and the sides of the connected area of the first sash frames 50 are punched, the punched parts of the first window frames 20 made of synthetic resin, the punched parts of the first sash frames 50 made of synthetic resin and the punched parts of the angle pieces 80 made of metal are deformed/cut, so that the punched and deformed/cut parts 81 of each angle piece 80 are bent into the receiving grooves 71 of each corner piece 70 and therefor the angle piece 80 and the corner piece 70 are securely joined together.

Since the angle piece 80 and the corner piece 70 are securely fixed to each other as the punched and deformed/cut parts 81 of the angle piece 80 are bent into the receiving grooves 71 of the corner piece 70 upon punching, the window frame compression flanges 22 of the first window frames 20 positioned therebetween and the sash frame compression flanges 52 of the first sash frames 50 positioned therebetween are securely connected between the angle piece 80 and the corner piece 70. Therefore, the joint of the first window frames 20 made of synthetic resin and the joint of the first sash frames 50 made of synthetic resin are prevented from loosening or deteriorating.

Third, the window frame joint grooves 21 are lengthwise formed in the first window frame 20 made of synthetic resin and the sash frame joint grooves 51 are lengthwise formed in the first sash frame 50 made of synthetic resin. The window frame joint tongues 31 are lengthwise formed in the second window frame 30 made of metal and the sash frame joint tongues 61 are lengthwise formed in the second sash frame 60, so that the window frame joint tongues 31 are connected with the window frame joint grooves 21 by a sliding motion and the sash frame joint tongues 61 are connected with the sash frame joint grooves 51 by a sliding motion.

Accordingly, after the window frame joint grooves 21 of the first window frame 20 are slidably connected with the window frame joint tongues 31 of the second window frame 30 and the sash frame joint grooves 51 of the first sash frame 50 are slidably connected with the sash frame joint tongues 61 of the second sash frame 60, the top and bottom of the joined area thereof are pressurized by using the roller so that the window frame joint tongues 31 are pressurized to be connected with the window frame joint grooves 21 and the sash frame joint tongues 61 are pressurized to be connected with the sash frame joint grooves 51.

The assembly is completed by relatively simple work of pressing the top and bottom of the component made of metal after connecting two components made of different materials by a sliding motion. Since the window frame 10 using different materials and the sash frame 40 using different materials in the unique structure are very simply assembled, the end product assembly is improved.

Figure 12:
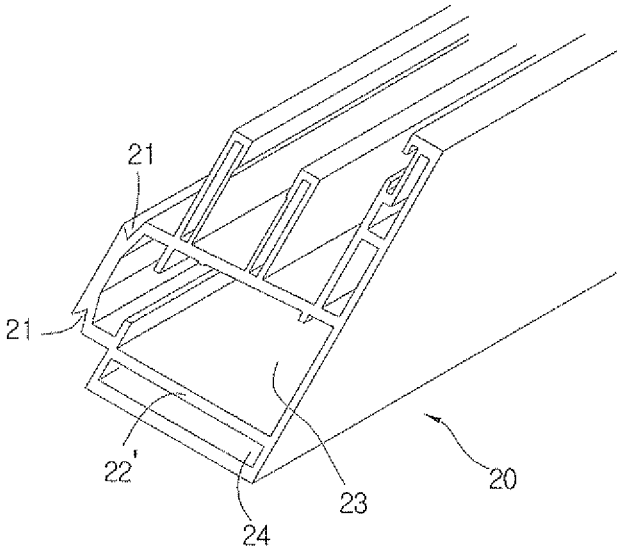
FIGS. 12 and 13 are partially perspective views a prefabricated structure for a composite window/door apparatus using different frame materials according to another embodiment of the present invention.
Figure 13:
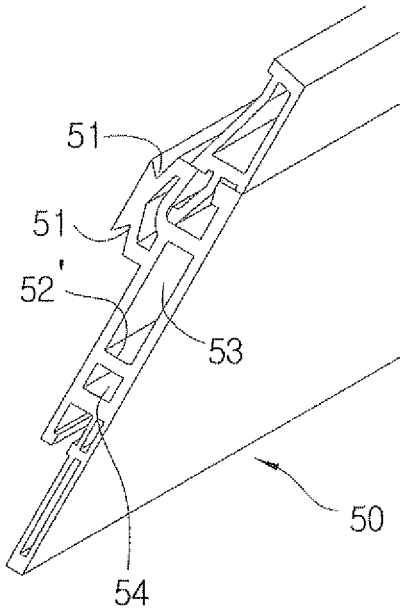

FIGS. 12 and 13 are partially perspective views a prefabricated structure for a composite window/door apparatus using different frame materials according to another embodiment of the present invention.

The present invention is characterized by the window frame compression flange 22 and the sash frame compression flange 52. In the another embodiment of the present invention, a window frame compression plate 22' and a sash frame compression plate 52' may be formed in stead of the window frame compression flange 22 and the sash frame compression flange 52. Each of the window frame compression plate 22' and the sash frame compression plate 52' has a cross-section in a shape which is formed in a plate shape in the length direction of each of the window frame 10 using different materials and the sash frame 40 using different materials. Therefore, the corner piece paths 23, 53 and the angle piece paths 24, 54 are separated by the window frame compression plate 22' and the sash frame compression plate 52' as shown in FIGS. 12 and 13.

In the prefabricated structure of a composite window/door apparatus using different frame materials according to the another embodiment of the present invention, since the window frame compression plate 22' and the sash frame compression plate 52' are formed in the "-" shape, the punching area is increased and therefore the punching location selection is relatively widened. Further, since the front and back sides of the first window frame 20 are clearly supported by the window frame compression plate 22' and the front and back sides of the first sash frame 50 are clearly supported by the sash frame compression plate 52', the first window frame 20 and the first sash frame 50 become firmer.

DESCRIPTION OF NUMBERS FOR CONSTITUENTS IN DRAWINGS

10: window frame using different materials
20: first window frame
21: window frame joint grooves
22, 22': window frame compression flange (plate)
23,53: corner piece paths
24,54: angle piece paths
30: second window frame
31: window frame joint tongues
40: sash frame using different materials
50: first sash frame
51: sash frame joint grooves
52, 52': sash frame compression flange (plate)
60: second sash frame
61: sash frame joint tongues
70: corner piece
71: receiving grooves
80: angle piece
81: punched and deformed/cut parts
ED: exterior window/door
ID: interior window/door

The invention claimed is:

1. A prefabricated structure for a composite window apparatus comprising a window frame including an inner first window frame (20) made of synthetic resin and an outer second window frame (30) made of metal and connected with the inner first window frame (20), wherein the inner first window frame (20) having both ends cut at 45 degrees includes a corner piece path (23) and an angle piece path (24) which are lengthwise formed inside the inner first window frame (20), with window frame compression flanges (22) being lengthwise formed between the corner piece path (23) and the angle piece path (24) and protruding into an interior of the inner first window frame (20) from each of a first inside wall and a second inside wall of the inner first window frame (20), the window frame having an assembled state, wherein the corner piece paths (23) and the angle paths (24) of adjacent inner first window frames (20), positioned horizontally and vertically, receive a corner piece (70) and an angle piece (80) both made of metal, and the window frame having a secured state, wherein the angle piece (80) includes apertures and punched edges (81) abutting the apertures of the angle piece (80) and wherein the punched edges are bent towards, and into, the corner piece (70), such that the bent punched edges press against the window frame compression flanges (22) so that corners of the inner first window frames (20) are forcibly connected with the angle piece (80) and the corner piece (70) so as to secure the inner first window flames (20), and wherein the corner piece (70) includes receiving grooves (71) formed at an outer surface of the corner piece, wherein the apertures are opposite the receiving grooves and the angle piece (80) includes the punched edges (81) that are bent towards and forcibly connected with the receiving grooves (71) of the corner piece (70), such that in the assembled state the corner piece and the angle piece are removably received and in the secured state the corner piece and the angle piece are irremovably secured in place.

2. The prefabricated structure according to claim 1, wherein the inner first window frame (20) further includes window frame joint grooves (21) which are formed lengthwise, the outer second window frame (30) further includes window frame joint tongues (31) which are formed lengthwise and adapted in the assembled state are slidably connected with and proximate the window frame joint grooves (21), in an assembly engagement and in the secured state the window frame joint tongues (31) are positioned completely within the window frame joint grooves (21) in a locking engagement, so that the window frame joint grooves (21) and the window frame joint tongues (31) are connected each other.

3. A prefabricated structure for a composite window apparatus in which a sash frame including an inner, first window sash frame (50) made of synthetic resin and an outer, second window sash frame (60) made of metal and connected with the first window sash frame (50), wherein the first window sash frame (50) having both ends cut at 45 degrees includes a corner piece path (53) and an angle piece path (54) which are lengthwise formed inside the first window sash frame (50), with window frame compression flanges (52) being lengthwise formed between the corner piece path (53) and the angle piece path (54) and protruding into an interior of the first window sash frame (50) from each of a first inside wall and a second inside wall of the first window sash frame (50), sash frame having an assembled state assembled, wherein the corner piece paths (53) and the angle paths (54) of adjacent first window sash frames (50) positioned horizontally and vertically receive a corner piece (70) and an angle piece (80) both made of metal, and the sash frame having a secured state, wherein the angle piece (80) includes apertures and flanges (81) abutting the apertures, wherein the flanges of the angle piece (80) are bent towards and into the corner piece (70) such that the bent flanges press against the window frame compression flanges (52) so that the corners of the first window sash frames (50) are forcibly connected with the angle piece (80) and the corner piece (70), and wherein the corner piece (70) includes receiving grooves (71) formed at an outer surface of the corner piece, wherein the apertures are opposite the receiving grooves and the angle piece (80) includes the punched parts (81) that are bent towards and forcibly connected with the receiving grooves (71) of the corner piece (70), such that in the assembled state the corner piece and angle piece are removably received and in the secured state the corner piece and angle piece are irremovably secured in place.

4. The prefabricated structure according to claim 3, wherein the first window sash frame (50) further includes window frame joint grooves (51) which are formed lengthwise, the second window sash frame (60) further includes window frame joint tongues (61) which are formed lengthwise and in the assembled state are slidably connected with and proximate the window frame joint grooves (51) in an assembly engagement, and in the secured state the window frame joint tongues (61) are positioned completely within the window frame joint grooves (51) in a locking engagement, so that the window frame joint grooves (51) and the window frame joint tongues (61) are connected each other.

* * * * *